US012735958B2

(12) United States Patent
Pyke et al.

(10) Patent No.: US 12,735,958 B2
(45) Date of Patent: Sep. 15, 2026

(54) SYSTEM AND METHOD FOR MOBILE DRILLING MACHINE

(71) Applicant: Caterpillar Inc., Peoria, IL (US)

(72) Inventors: Sandy Wayne Pyke, Saint-Constant (CA); Virajkumar Gohil, Montreal (CA)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/982,244

(22) Filed: Dec. 16, 2024

(65) Prior Publication Data

US 2026/0168360 A1 Jun. 18, 2026

(51) Int. Cl.
*E21B 41/00* (2006.01)
*E21B 12/00* (2006.01)

(52) U.S. Cl.
CPC ..... *E21B 41/0085* (2013.01); *E21B 12/00* (2013.01)

(58) Field of Classification Search
CPC ..... E21B 41/0085; E21B 12/00
See application file for complete search history.

(56) References Cited

U.S. PATENT DOCUMENTS

| | | | | |
|---|---|---|---|---|
| 6,150,601 | A | 11/2000 | Schnatzmeyer et al. | |
| 8,284,075 | B2 | 10/2012 | Fincher et al. | |
| 8,528,661 | B2 | 9/2013 | Patel et al. | |
| 9,523,263 | B2 | 12/2016 | Downie et al. | |
| 10,145,215 | B2 | 12/2018 | Hay | |
| 10,273,784 | B2 | 4/2019 | Winslow et al. | |
| 2017/0107795 | A1* | 4/2017 | Yeo | E21B 41/0085 |
| 2018/0187539 | A1* | 7/2018 | Hadi | E21B 12/00 |
| 2018/0202288 | A1* | 7/2018 | Elbadawy | E21B 7/007 |
| 2021/0364194 | A1* | 11/2021 | Gleadhill | H10N 10/13 |
| 2022/0056797 | A1* | 2/2022 | Hall | E21B 47/00 |
| 2022/0356788 | A1* | 11/2022 | Till | E21B 41/0085 |
| 2023/0188167 | A1* | 6/2023 | Wilenski | H04B 1/02 340/854.3 |

FOREIGN PATENT DOCUMENTS

| | | | |
|---|---|---|---|
| CN | 113153222 | B | 12/2022 |
| CN | 115788405 | A | 3/2023 |
| EP | 2748428 | B1 | 7/2018 |
| KR | 20230049374 | A | 4/2023 |

OTHER PUBLICATIONS

Written Opinion and International Search Report for Int'l. Patent Appln. No. PCT/US2025/055696, mailed Mar. 30, 2026 (10 pgs).

* cited by examiner

*Primary Examiner* — Brad Harcourt

(57) ABSTRACT

A power generator of a drill string of a mobile machine includes a thermal electric generator positioned along the drill string, the thermal electric generator configured to generate power using a portion of bailing air flowing through the drill string, the portion of the bailing air being diverted to the thermal electric generator; and one or more components positioned along the drill string, the one or more components configured to receive power generated by the thermal electric generator.

20 Claims, 4 Drawing Sheets

SYSTEM AND METHOD FOR MOBILE DRILLING MACHINE

TECHNICAL FIELD

The present disclosure relates generally to mobile drilling machines, and more particularly, to systems and methods associated with such machines.

BACKGROUND

Mobile drilling machines, such as blasthole drilling machines, are typically used for drilling blastholes for mining and quarrying applications. The process of excavating rock, or other material, by blasthole drilling includes using the blasthole drilling machine to drill a plurality of holes into the intact rock mass and filling the blastholes with explosives. The explosives are detonated in a controlled manner, causing the rock to fragment and be displaced, after which the fragmented rock is removed using an excavating machine. Many current blasthole drilling machines utilize rotary or rotary-percussive drilling methods where axial and rotational energy that is produced by hydraulic or electric motors mounted on a rotary head that is connected to a drill string (which may include multiple pipes, a shock sub isolator, and a tricone or down-the-hole hammer bit), drill vertical and inclined blastholes anywhere between 6 inches and 22 inches in diameter, with typical depths of up to 30 meters or less.

U.S. Pat. No. 8,284,075, issued Oct. 9, 2012 ("the '075 patent"), discloses a drill string having a plurality of self-powered, autonomous telemetry stations disposed at predetermined locations along the drill string, the autonomous telemetry stations including transmitters and various sensors measuring drilling-related parameters. The '075 patent further discloses that piezoelectric materials mounted on the autonomous telemetry stations generate power to operate the sensors and transmitters, the piezoelectric materials generating power as a result of vibrations experienced by the drill string and thus by the autonomous telemetry stations. However, the '075 patent does not disclose generating electrical power in the absence of vibrations. Further, dampening the vibration of the drill string, which is often desirable to increase the useful lifetime of components of the drill string, reduces the amount of power generated by the system of the '075 patent.

The systems and methods of the present disclosure may address or solve one or more of the problems set forth above or other problems in the art. The scope of the current disclosure, however, is defined by the attached claims, and not by the ability to solve any specific problem.

SUMMARY

In one aspect, a power generator of a drill string of a mobile machine includes a thermal electric generator positioned along the drill string, the thermal electric generator configured to generate power using a portion of bailing air flowing through the drill string, the portion of the bailing air being diverted to the thermal electric generator; and one or more components positioned along the drill string, the one or more components configured to receive power generated by the thermal electric generator.

In another aspect, a thread saver assembly for a drill string includes a thread saver body including a top section, a bottom section, and an intermediate section between the top and bottom sections; a power generator assembly comprising a thermal electric generator positioned within or on a sidewall of the intermediate section, the thermal electric generator configured to generate power using a portion of bailing air flowing through the thread saver body, the portion of bailing air being diverted into the thermal electric generator; and one or more components positioned within or on the thread saver body, the one or more components configured to receive power generated by the thermal electric generator.

In yet another aspect, a method of generating power includes diverting a portion of bailing air flowing through a drill string and through a thermal electric generator positioned in or on the drill string; generating power with the thermal electric generator; and transmitting power to one or more components positioned in the drill string.

BRIEF DESCRIPTION OF THE DRAWINGS

The accompanying drawings, which are incorporated in and constitute a part of this specification, illustrate various exemplary embodiments and together with the description, serve to explain the principles of the disclosure.

DETAILED DESCRIPTION

Both the foregoing general description and the following detailed description are exemplary and explanatory only and are not restrictive of the features, as claimed. As used herein, the terms "comprises," "comprising," "having," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Further, relative terms, such as, for example, "about," "substantially," "generally," and "approximately" are used to indicate a possible variation of ±10% in a stated value. Still further, the terms "one or more" and "at least one" are used to indicate one, two, or more than two.

Figure 1:
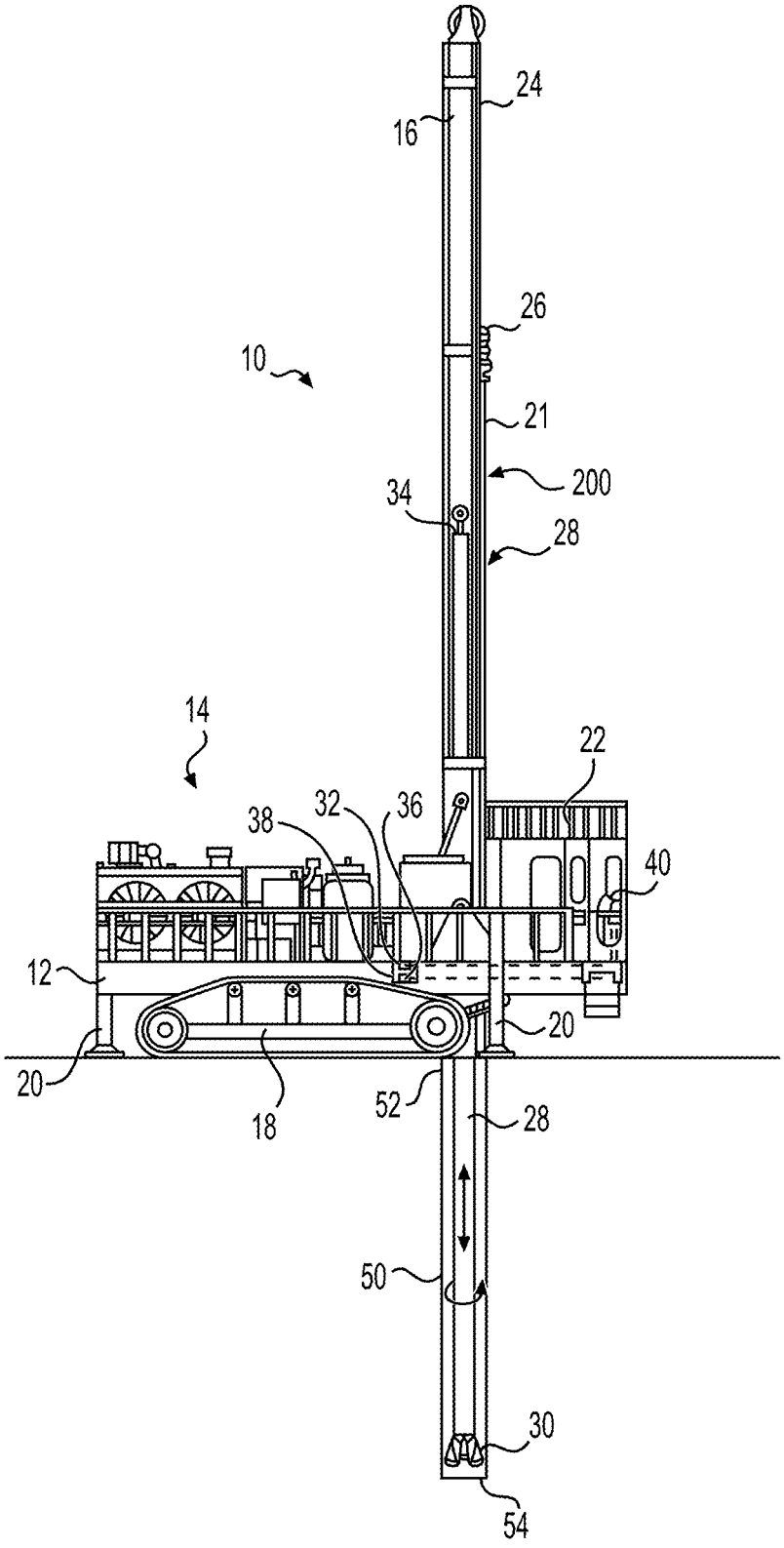
FIG. 1 illustrates a schematic side view of a mobile drilling machine, according to aspects of the disclosure.

With reference to the drawings, FIG. 1 illustrates a schematic side view of an exemplary mobile drilling machine 10, according to some aspects of the disclosure. Although the disclosure herein may be applicable to any type of drilling machine, whether performing rotary-percussive or rotary drilling, reference will be made below particularly to a mobile blasthole drilling machine. As shown in FIG. 1, mobile drilling machine 10 may include a frame 12, machinery 14, and a drilling mast 16. Frame 12 may be supported on a ground surface by a transport mechanism 18, such as crawler tracks (or wheels). Transport mechanism 18 may allow mobile drilling machine 10 to maneuver about the ground surface to a desired location for a drilling operation.

Frame 12 may further include one or more jacks 20 (two shown in FIG. 1) for supporting and leveling mobile drilling machine 10 on the ground surface during the drilling operation. Frame 12 may support machinery 14, which may include engines, motors, batteries, pumps, air compressors, a hydraulic fluid storage tank 38 (shown schematically in FIG. 1), or any other equipment necessary or desirable to power and operate mobile drilling machine 10. Frame 12 may further support an operator cab 22, from which an operator may maneuver and control mobile drilling machine 10 via an input device 40, including user interfaces or displays. Although FIG. 1 illustrates input device 40 in operator cab 22 that is supported on frame 12 of mobile drilling machine 10, input device 40 may be located remote from mobile drilling machine 10 (e.g., not within or on frame 12 or any other component of mobile drilling machine 10), such that mobile drilling machine 10 may be controlled remotely by the operator. In some instances, mobile drilling machine 10 may operate autonomously or semi-autonomously.

As FIG. 1 illustrates, drilling mast 16 may include a mast frame 24, which may support a rotary head 26 movably mounted on mast frame 24. Rotary head 26 may couple to, and may be controllable to rotate, a drill string 28 including one or more drilling pipe sections, on which a drill bit 30 may be mounted for drilling into the ground surface, as further described below. In some aspects, when drill string 28 reaches its maximum depth, drill string 28 may include multiple (e.g., more than one) drilling pipe sections, while in other aspects, drill string 28 may include only one drilling pipe section when drill string 28 is at its maximum depth. In some instances, the one or more drilling pipe sections may be approximately 10 meters to approximately 15 meters in length, although the drilling pipe sections may be greater than approximately 15 meters in length, or less than approximately 10 meters in length.

As FIG. 1 illustrates, drill string 28 may include a shock sub isolator assembly 21 as well as a thread saver assembly 200 between rotary head 26 and the one or more drilling pipe sections. Shock sub isolator assembly 21 may dampen vibrations generated by drilling which are transmitted through drill string 28, including vibrations transmitted to rotary head 26. Shock sub isolator assembly 21 may be threaded on both ends thereof, such that shock sub isolator assembly 21 may be connected to and disconnected from a correspondingly-threaded end of rotary head 26. Thus, shock sub isolator assembly 21 may be removable and replaceable when shock sub isolator assembly 21 reaches the end of its service life. Thread saver assembly 200 also may be threaded on both ends thereof, such that thread saver assembly 200 may be connected to and disconnected from a correspondingly-threaded end of shock sub isolator assembly 21, as well as a correspondingly-threaded end of the drilling pipe section. Thus, thread saver assembly 200 may be removable and replaceable when thread saver assembly 200 reaches the end of its service life. Further, the use of thread saver assembly 200 may prevent damage to the threads of shock sub isolator assembly 21, or to the threads of rotary head 26 (when drill string 28 omits shock sub isolator assembly 21) that would result by connection and disconnection of the drilling pipe sections to shock sub isolator assembly 21 or to rotary head 26 (when drill string 28 omits shock sub isolator assembly 21).

At the end of drill string 28, mobile drilling machine 10 may include a drill bit 30. Drill bit 30 may include different types of drill bits, such as a rotary drill bit (e.g., a tricone drill bit), a claw drill bit, a down-the-hole bit, or another drill bit type. Rotary head 26 may be any type of rotary head, such as a hydraulically or electrically powered rotary head or the like. Rotary head 26 may further include a hydraulic fluid line (not shown) for receiving hydraulic fluid. The hydraulic fluid may be used to rotate a shaft of rotary head 26 on which drill string 28 is connected for rotating drill string 28 (and thus rotating drill bit 30). The hydraulic fluid line of rotary head 26 may be coupled to a hydraulic valve 32 (shown schematically in FIG. 1) for controlling the amount, and flow rate, of the hydraulic fluid into rotary head 26. In the exemplary embodiment, hydraulic valve 32 may be located on hydraulic fluid storage tank 38. However, hydraulic valve 32 may be located anywhere along the hydraulic fluid line of rotary head 26, as necessary or desired.

Drilling mast 16 may further include a hydraulic feed cylinder 34 (located within mast frame 24) connected to rotary head 26 via a cable and pulley system (not shown) for moving rotary head 26 up and down along mast frame 24. As such, when hydraulic feed cylinder 34 is extended, hydraulic feed cylinder 34 may exert a force on rotary head 26 for pulling-down rotary head 26 along mast frame 24. Further, when hydraulic feed cylinder 34 is retracted, hydraulic feed cylinder 34 may exert a force on rotary head 26 for hoisting up rotary head 26 along mast frame 24. Thus, hydraulic feed cylinder 34 may be controllable to move rotary head 26 up and down mast frame 24 such that drill bit 30 on drill string 28 may be pulled-down towards, and into, the ground surface or hoisted up from the ground surface. As used herein, the term "feed" in the context of hydraulic feed cylinder 34 may include movement of drill string 28 in either direction (up or down). Hydraulic feed cylinder 34 may include hydraulic fluid lines (not shown) for receiving and conveying hydraulic fluid to and from hydraulic feed cylinder 34. The hydraulic fluid may be used to actuate hydraulic feed cylinder 34 such that a rod of hydraulic feed cylinder 34 may be extended or retracted. The hydraulic fluid line of hydraulic feed cylinder 34 may be coupled to hydraulic valves 36 (shown schematically in FIG. 1) for controlling the amount, as well as flow rate and pressure, of the hydraulic fluid into hydraulic feed cylinder 34. In the exemplary embodiment, hydraulic valve 36 may be located on hydraulic fluid storage tank 38. However, hydraulic valve 36 may be located anywhere along or in fluid communication with the hydraulic fluid line of the hydraulic feed cylinder 34, as necessary or desired. It is understood that hydraulic fluid may be any type of hydraulic fluid, such as hydraulic oil or another fluid. In some instances, drilling mast 16 may include an electrical system, in place of or in addition to hydraulic feed cylinder 34 and the above-described associated hydraulic components, for moving rotary head 26 up and down along mast frame 24.

FIG. 1 shows drill string 28 located in a hole 50 drilled by drill string 28. Hole 50 may include a top 52 of hole 50, and a bottom 54 of hole 50 (e.g., desired depth of hole). As shown by the arrows in FIG. 1, drill string 28 may rotate, and move up and down (e.g., feed and retract/hoist) such that drill bit 30 rotates and moves up and down, respectively. Drill bit 30 may also reciprocate (e.g., when a down-the-hole hammer is added to the drill string, such as at the top of drill string 28 near rotary head 26, or at the bottom of drill string 28 behind drill bit 30).

Mobile drilling machine 10 may include, as part of machinery 14, an air compressor (not shown), and drill string 28 may include an airline (not shown) for supplying bailing air from the air compressor through an interior of drill string 28, including through an interior of thread saver assembly 200, as well as through drill bit 30, into hole 50. The bailing air may clear out rubble from within hole 50 and may cool drill bit 30. The bailing air provided by the air compressor which flows through drill string 28 may have a volumetric flow rate of between approximately 3200 and approximately 3600 cubic feet per minute (CFM). However, the flow rate of the bailing air may be greater than approximately 3600 CMF, or may be less than approximately 3200 CFM.

Figure 2A:
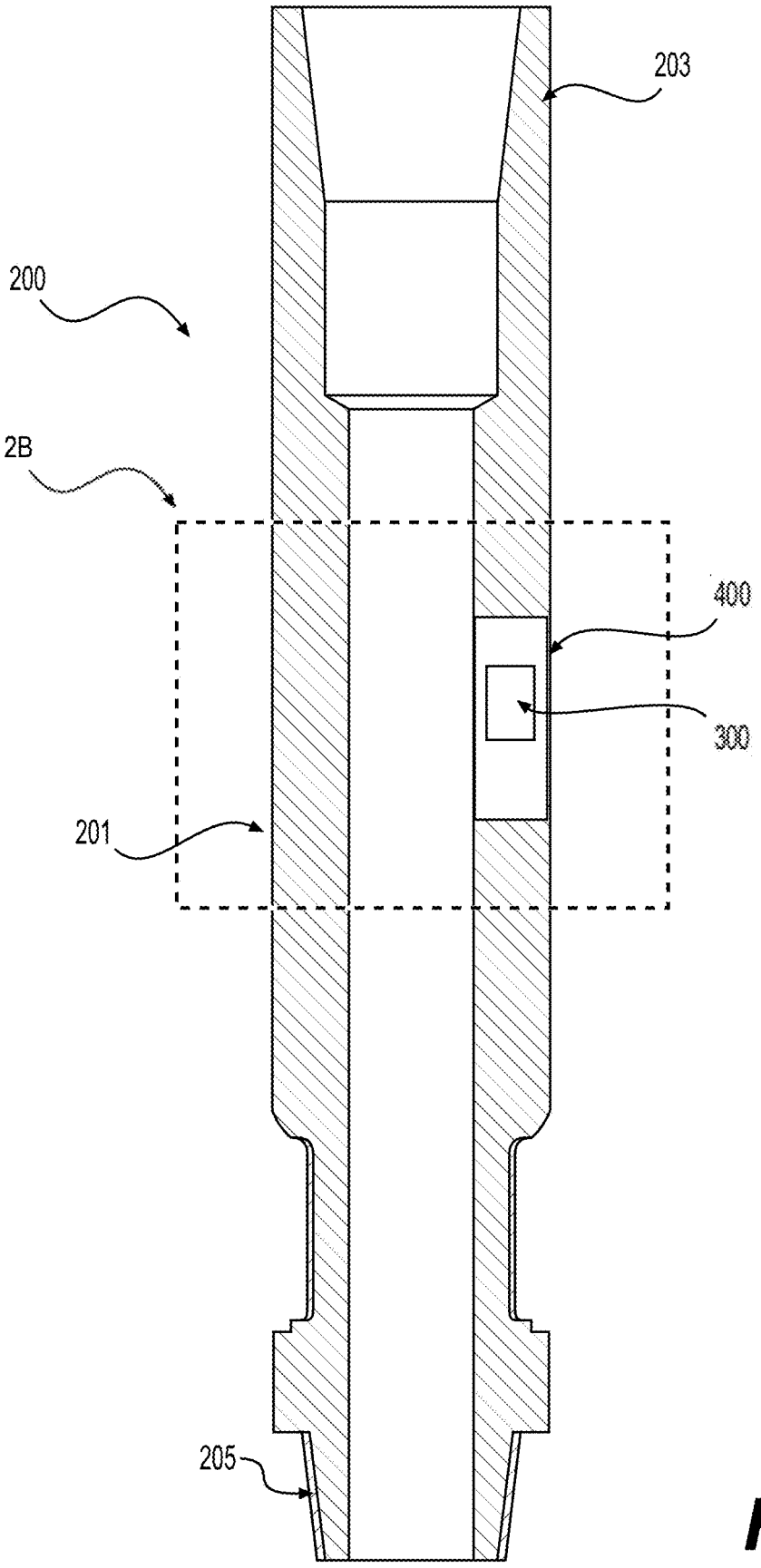
FIG. 2A illustrates a schematic cross-sectional view of a thread saver assembly of the mobile drilling machine of FIG. 1, according to aspects of the disclosure.
Figure 2B:
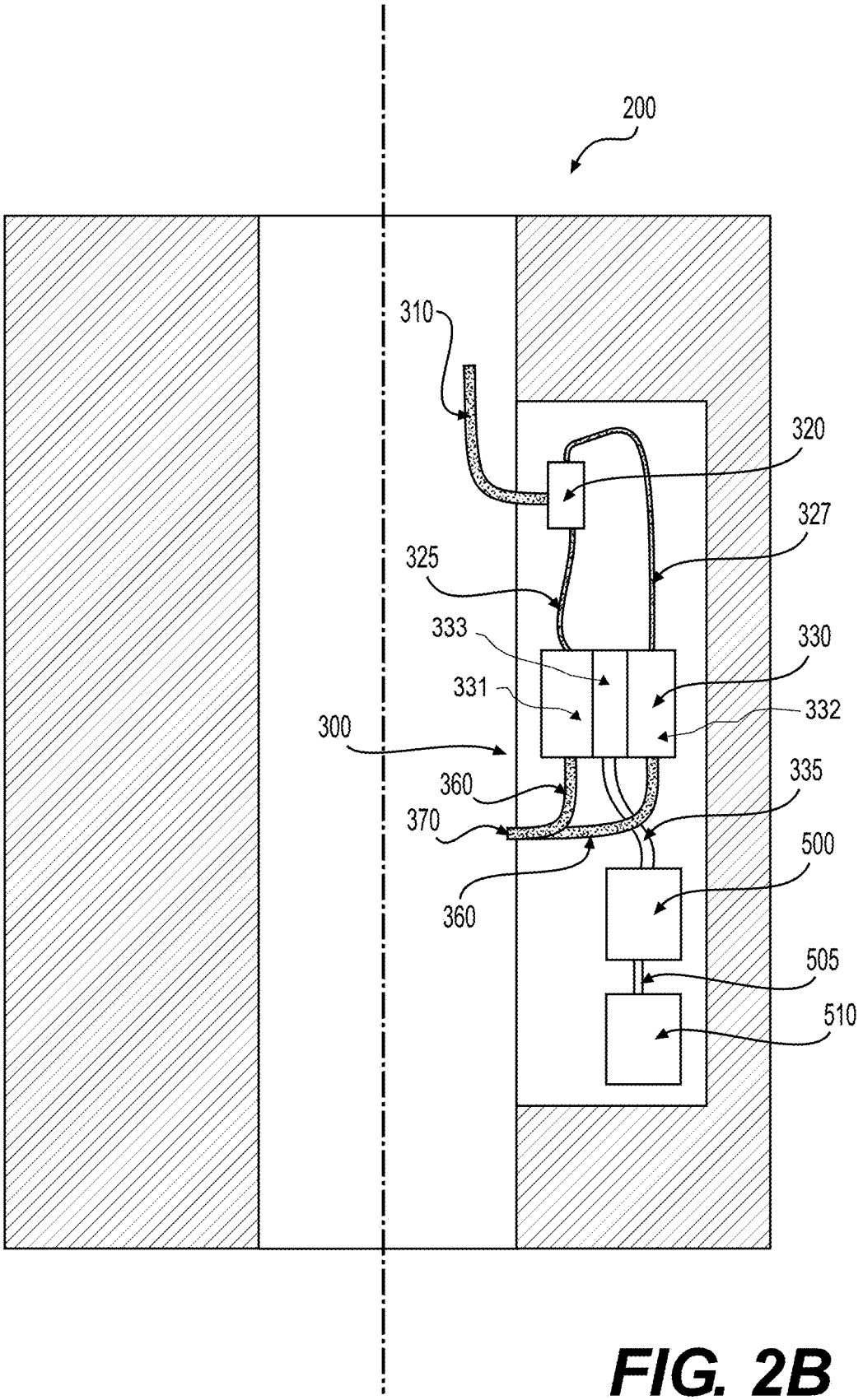
FIG. 2B illustrates a detailed cross-sectional view of the thread saver assembly including a power generator assembly, the view taken from box 2B in FIG. 2A, according to aspects of the disclosure.

FIG. 2A illustrates a cross-sectional view of thread saver assembly 200, while FIG. 2B illustrates a detail cross-sectional view of thread saver assembly 200 taken from box 2B in FIG. 2A, according to aspects of the disclosure. As FIGS. 2A and 2B illustrate, thread saver assembly 200 may include a thread saver body having a generally cylindrical section 201 between a top section 203 with internal threads (threads not shown in the figures) that connect to and disconnect from a corresponding externally-threaded section of shock sub isolator assembly 21 or to rotary head 26 (when drill string 28 omits shock sub isolator assembly 21), and a bottom section 205 with external threads (threads not shown in the figures) that connect to and disconnect from a corresponding internally-threaded section of the drilling pipe section, such that generally cylindrical section 201 is an intermediate body section between the top and bottom body sections. In some instances, generally cylindrical section 201 of thread saver assembly 200 may have an inner diameter of approximately 6 inches, a sidewall thickness of approximately 3 inches, and an outer diameter of approximately 12 inches, while an overall length of thread saver assembly 200 may be between approximately 1 meter and approximately 1.5 meters. In some aspects, the inner diameter of generally cylindrical section 201 of thread saver assembly 200 may be greater or less than approximately 6 inches, the sidewall thickness may be greater or less than approximately 3 inches, and the outer diameter may be greater or less than approximately 12 inches, while the length of thread saver assembly 200 may be greater than approximately 1.5 meters or less than approximately 1 meter.

As FIGS. 2A and 2B illustrate, thread saver assembly 200 may include a power generator assembly 300, in the form of a wireless power generator assembly. In this context, "wireless" refers to power generator assembly 300 generating power for components within and on drill string 28, without the use of wires transmitting power from outside of drill string 28 to the components within and on drill string 28, as further described.

Power generator assembly 300 may be disposed within a cavity 400 formed in the sidewall of thread saver assembly 200. The cavity 400 may be machined or otherwise formed in the sidewall of thread saver assembly 200. Although not shown in FIGS. 2A and 2B, cavity 400 may include inner and outer doors or access panels, for example, or other structure that may open and close to permit and prevent, respectively, access to cavity 400 from the interior or the exterior of thread saver assembly 200. Power generator assembly 300 may generate power by flowing a portion of the bailing air through power generator assembly 300, as further described.

Power generator assembly 300 may include a pitot tube 310 extending from cavity 400, into the interior of thread saver assembly 200 through which the bailing air flows. Pitot tube 310 may divert a portion of the bailing air flowing through drill string 28 into power generator assembly 300. For example, pitot tube 310 may divert approximately 1% or less of the available air flowing through drill string 28. In some instances, pitot tube 310 may divert more than approximately 1% of the available air flowing through drill string 28.

Power generator assembly 300 may include a vortex tube 320, which may be in fluid communication with pitot tube 310, such that vortex tube 320 may receive the portion of the bailing air diverted into pitot tube 310. Vortex tube 320 may separate the air flowing in from pitot tube 310, into both a hot air stream and a cold air stream. The hot air stream may exit a hot air stream side of vortex tube 320, and flow through a hot air conduit 325 in fluid communication with vortex tube 320. The cold air stream may exit a cold air stream side of vortex tube 320, and flow through a cold air conduit 327 in fluid communication with vortex tube 320, where cold air conduit 327 is separate from hot air conduit 325. Hot air conduit 325 and cold air conduit 327 may be set apart from one another, or insulated, to minimize an amount that the hot air in hot air conduit 325 heats the cold air in cold air conduit 327, and vice versa. The separation and insulation may also prevent hot and cold air losses to the environment (which may be from about −40 to about +85 degrees Celsius) and the air flowing in drill string 28 (which may be about +50 degrees Celsius).

A thermal electric generator 330 may include a hot air side heat exchanger 331, a cold air side heat exchanger 332, and the thermal electric generator module 333, and may receive both the hot and cold air streams from hot air conduit 325 and cold air conduit 327, respectively. Thermal electric generator 330 may generate power as a result of a differential in temperature between the hot and cold air streams. In some instances, thermal electric generator 330 may generate DC power. The DC power may depend on the application, and may be in the order of approximately 5 watts.

A power converter 500 may be connected to power generator assembly 300 through wires 505. Power converter 500 may convert the DC power generated by thermal electric generator 330 to a voltage or a current suitable for use or storage by a sensor power supply 510, such as by utilizing maximum power point tracking (MPPT) techniques. For example, power converter 500 may convert the received DC power into DC power suitable for battery charging, such as DC power of approximately 3.6 volts and approximately 1.4 amps. Sensor power supply 510 may store DC power for use by components and sensors, and convert that stored power into a voltage that is suitable for use by one or more sensors or sensor packages, such as DC power of approximately 12 volts and approximately 0.4 amps, as further described. Sensor power supply 510 may be in the form of a battery combined with a DC-DC converter. Sensor power supply 510 may store power having a capacity of approximately 120 watt-hours, to allow sensor power supply 150 to operate for approximately 24 hours without airflow.

The hot and cold air streams may flow out of thermal electric generator 330 through exit conduits 360, which may return the portion of the bailing air that was diverted through power generator assembly 300 back to the bailing air stream that is flowing through the interior of thread saver assembly 200. Exit conduits 360 may include venturi tubes, which may increase the speed of the hot and cold air streams exiting thermal electric generator 330 to be substantially the same as the velocity of the bailing air flowing through thread saver assembly 200. Thus, neither the volume nor the flow rate of the bailing air flowing through drill string 28, which is used to clear rubble out of components of drill string 28, drill bit 30, and hole 50, may be reduced by diversion and return of a portion of the bailing air.

Power generator assembly 300 may return the separate hot and cold air streams directly to the bailing air stream through the two exit conduits 360, or power generator assembly 300 may include a mixing conduit 370 that receives the hot and cold air streams from the two exit conduits 360, mixing conduit 370 mixing the hot and cold air streams with one another before returning the combined or mixed air stream back to the bailing air stream.

In some instances, one or more components of power generator assembly 300 may be manufactured as a single unit. For example, components of power generator assembly 300 including pitot tube 310, vortex tube 320, hot air conduit 325, and cold air conduit 327 may be manufactured as a single unit. The single unit may be manufactured by an additive manufacturing process, such as three-dimensional printing. In some instances, the single unit may include thermal electric generator 330. In some instances, the single unit may include exit conduits 360, with or without mixing conduit 370. The single unit may be printed or otherwise manufactured from a polymer (e.g., plastic) material. When the single unit includes any of the described conduits, the single unit may include thin wall metal films (e.g., nickel) lining one or more of the conduits.

One or more components 600 may be mounted within or to the interior or an exterior of thread saver assembly 200, which may sense or transmit information relevant to operation of drill string 28 or related to hole 50, as further described. Components 600 may be in electrical communication with power generator assembly 300, such that components 600 are powered by power generator assembly 300. One or more of components 600 may be in the form of a transmitter, such as a radio-frequency transmitter. The transmitter may transmit information from drill string 28 to one or more fixed receivers installed on mobile drilling machine 10, for example, and vice versa. One or more of components 600 may be in the form of a strain gauge, a piezoelectric transducer, a gyroscope, or a multi-axis micro electric mechanical system (multi axis MEMS), or integrated within various sensors. One or more of components 600 may be in the form of the following sensors, which may be mounted to the interior or the exterior of, or within, thread saver assembly 200. For example, radiofrequency ranging between the transmitter installed on drill string 28 and the receivers installed on mobile drilling machine 10 may be used to determine the position of rotary head 26. A pulldown pressure sensor, which may include a strain gauge, may be used to determine a weight on drill bit 30. A rotary torque sensor, which may include pressure sensors having piezoelectric transducers, are attached to the hydraulic motor fluid inlet and outlet lines to determine a torque that is applied on drill string 28. A pressure sensor, which may include a piezoelectric transducer, may be used to determine a pressure of the bailing air flowing through a portion of drill string 28, such as through thread saver assembly 200. A rotary speed sensor, which may include a gyroscope, may be used to determine a rotary speed of drill string 28. A vibration sensor, which may include a multi axis MEMS, may be used to determine vibrations on portions of drill string 28, such as before the shock sub isolator assembly 21. An accelerometer, which may include a multi axis MEMS, may be used to determine the angle of mast frame 24 with respect to the gravitational acceleration. Although the foregoing describes specific exemplary components 600, including specific exemplary sensors, components 600 may include additional, other, or different components or sensors. Although not shown in the figures, wires may be used to connect one or more of the components 600 to sensor power supply 510, thereby providing power from thermal electric generator 330 to components 600. As set forth and as understood, components 600 may sense information or transmit information to or from other components 600 as well as to systems outside of hole 50, such as to system in, on, or adjacent to mobile drilling machine 10.

Figure 3:
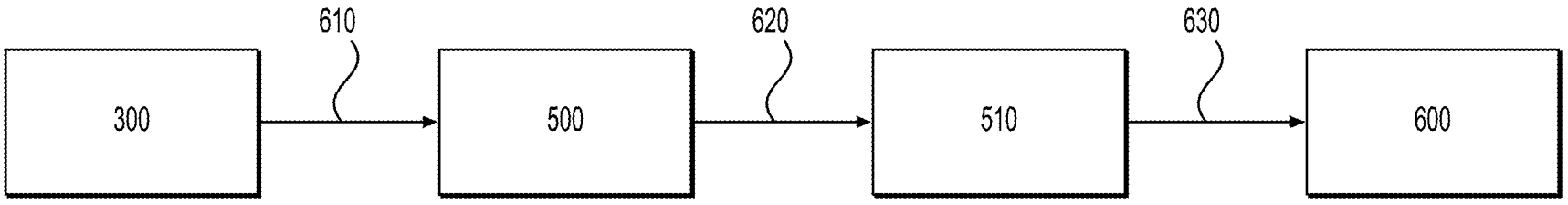
FIG. 3 is a schematic flow diagram illustrating power flow, according to aspects of the disclosure.

FIG. 3 is a schematic block diagram illustrating power flow. Power generator assembly 300 may generate power as described above, based on the difference in temperature between the hot and cold air streams flowing through thermal electric generator 330. Power generated by power generator assembly 300 is designated as power 610 in FIG. 3. Power 610 may be transferred from power generator assembly 300 to power converter 500, such as through wires 335, as described. Also as described, power converter 500 may convert the power received from power generator assembly 300 into a form usable by components 600. Power converted by power converter 500 is designated as power 620 in FIG. 3. Power 620 may be transferred from power converter 500 to sensor power supply 510, such as through wires 505. Power stored in sensor power supply 510 is designated as power 630 in FIG. 3. Power 630 may be transferred from sensor power supply 510 to one or more components 600, as described.

Although power generator assembly 300 is described above and illustrated in the figures as integrated in thread saver assembly 200, power generator assembly 300 is not limited to being located in thread saver assembly 200. For example, power generator assembly 300 may be integrated into or installed within any component of drill string 28 through which air (e.g., the bailing air) flows. By way of further example, power generator assembly 300 may be integrated into one or more of the drilling pipe sections, or rotary head 26. Further, although power generator assembly 300 is described above and illustrating in the figures as a component of mobile drilling machine 10, power generator assembly 300 is not limited to use in any particular machine, or limited to use in a mobile machine. Thus, power generator assembly 300 may be used in a stationary drilling machine that omits transport mechanism 18, for example.

INDUSTRIAL APPLICABILITY

The disclosed aspects of power generator assembly 300 may be used in thread saver assembly 200, or any other component of drill string 28 such as the drilling pipe sections, of a drilling machine.

As discussed, power generator assembly 300 may generate power to power components 600, such as one or more, or all of, a transmitter in the form of a radio-frequency transmitter, a strain gauge, a piezoelectric transducer, a gyroscope, or a multi-axis micro electric mechanical system (multi axis MEMS), which may be integrated within various sensors installed on the exterior or interior of thread saver assembly 200, for example. Power generator assembly 300 generates power based on the flow of bailing air through the interior of thread saver assembly 200. Accordingly, drill string 28 need not include wires that extend from above rotary head 26 down to a thread saver or drilling pipe section, for example, to provide power to sensors or components installed within or on any portion of drill string 28. Further, power generator assembly 300 generates power regardless of the extent to which drill string 28 vibrates.

It will be apparent to those skilled in the art that various modifications and variations may be made to the disclosed system without departing from the scope of the disclosure. Other embodiments of the disclosure will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A power generator of a drill string of a mobile machine, comprising:

a thermal electric generator positioned along the drill string, the thermal electric generator configured to generate power using a portion of bailing air flowing through an interior of the drill string, the portion of the bailing air being diverted to the thermal electric generator, wherein the thermal electric generator is configured to generate power based on a temperature differential between separated streams of the diverted portion of the bailing air before returning the portion of the bailing air back to the interior of the drill string and one or more components positioned along the drill string, the one or more components configured to receive power generated by the thermal electric generator.

2. The power generator of the drill string of claim 1, further comprising a vortex tube configured to separate the diverted portion of the bailing air into the separated streams, the separated streams including hot and cold air streams, wherein the thermal electric generator is configured to receive the hot and cold air streams, and to generate power based on the temperature differential between the hot and cold air streams.

3. The power generator of the drill string of claim 1, wherein the drill string comprises a thread saver threadingly-connected with a drilling pipe section, wherein the thermal electric generator is positioned within or on the thread saver.

4. The power generator of the drill string of claim 1, wherein the drill string comprises a thread saver threadingly-connected with a drilling pipe section, wherein the thermal electric generator is positioned within or on the thread saver, wherein at least one component of the one or more components is positioned within or on the thread saver.

5. The power generator of the drill string of claim 1, wherein the drill string comprises a thread saver threadingly-connected with a drilling pipe section, wherein the thermal electric generator is positioned within or on the thread saver, wherein at least one component of the one or more components comprises a sensor positioned within or on the thread saver, wherein at least one other component of the one or more components comprises a transmitter positioned within or on the thread saver, and the transmitter is configured to receive information from the sensor and to wirelessly transmit the received information to a location outside of a hole in which the drill string is positioned.

6. The power generator of the drill string of claim 1, further comprising a pitot tube, a vortex tube, a hot air conduit, and a cold air conduit, wherein the pitot tube is configured to divert the portion of the bailing air from the interior of the drill string, and to provide the diverted portion of the bailing air to the vortex tube, wherein the vortex tube is configured to separate the diverted portion of the bailing air into the separated streams, the separated streams including a hot air stream and a cold air stream, wherein the hot air conduit is in fluid communication with the vortex tube and the thermal electric generator, such that the hot air conduit is configured to flow the hot air stream to the thermal electric generator, wherein the cold air conduit is in fluid communication with the vortex tube and the thermal electric generator, such that the cold air conduit is configured to flow the cold air stream to the thermal electric generator, wherein the thermal electric generator is configured to generate power based on the temperature differential between the hot and cold air streams.

7. The power generator of the drill string of claim 6, wherein at least the vortex tube and the hot and cold air conduits are a single unit, wherein the single unit includes a polymer material, wherein the hot air conduit and the cold air conduit comprise a thin wall metal film on the polymer material.

8. A thread saver assembly for a drill string, comprising:

a thread saver body including a top section, a bottom section, and an intermediate section between the top and bottom sections;

a power generator assembly comprising a thermal electric generator positioned within or on a sidewall of the intermediate section and a mixing conduit, the thermal electric generator configured to generate power using a portion of bailing air flowing through the thread saver body, the portion of bailing air being diverted into the thermal electric generator, and the mixing conduit configured to mix separated streams of the diverted bailing air before returning the mixed bailing air back into the thread saver body; and one or more components positioned within or on the thread saver body, the one or more components configured to receive power generated by the thermal electric generator.

9. The thread saver assembly of claim 8, wherein at least one of the top section or the bottom section includes threads.

10. The thread saver assembly of claim 8, wherein an exterior of one of the top section or the bottom section includes external threads, and an interior of the other one of the top section or the bottom section includes internal threads.

11. The thread saver assembly of claim 8, wherein the power generator assembly is positioned with a cavity in the sidewall of the intermediate section.

12. The thread saver assembly of claim 8, wherein power generator assembly further comprises a vortex tube configured to separate the diverted portion of the bailing air into a hot air stream and a cold air stream, wherein the thermal electric generator is configured to receive the hot and cold air streams, and to generate power based on a temperature differential between the hot and cold air streams.

13. The thread saver assembly of claim 8, wherein at least one component of the one or more components comprises a sensor positioned within or on the thread saver body, wherein at least one other component of the one or more components comprises a transmitter positioned within the thread saver body or on a surface of the thread saver body, and the transmitter is configured to receive information from the sensor and to wirelessly transmit the received information to a location outside of the thread saver assembly.

14. The thread saver assembly of claim 8, wherein the power generator assembly further comprises a pitot tube, a vortex tube, a hot air conduit, and a cold air conduit, wherein the pitot tube is configured to divert the portion of the bailing air from an interior of the thread saver body, and to provide the diverted portion of the bailing air to the vortex tube, wherein the vortex tube is configured to separate the diverted portion of the bailing air into a hot air stream and a cold air stream, wherein the hot air conduit is in fluid communication with the vortex tube and the thermal electric generator, such that the hot air conduit is configured to flow the hot air stream to the thermal electric generator, wherein the cold air conduit is in fluid communication with the vortex tube and the thermal electric generator, such that the cold air conduit is configured to flow the cold air stream to the thermal electric generator, wherein the thermal electric generator is configured to generate power based on a temperature differential between the hot air stream and the cold air stream.

15. The thread saver assembly of claim 14, wherein a least a portion of the power generator assembly is a single unit including a polymer material, wherein the hot air conduit and the cold air conduit comprise a thin wall metal film on the polymer material.

16. The thread saver assembly of claim 14, wherein the power generator assembly further comprises exit conduits in fluid communication with the thermal electric generator, the exit conduits configured to return the hot and cold air streams to the bailing air flowing through the thread saver body.

17. A method of generating power, comprising:

diverting a portion of bailing air flowing through an interior of a drill string and through a thermal electric generator positioned in or on the drill string;

generating power with the thermal electric generator;

mixing separated streams of the diverted bailing air, after generating power, prior to returning the mixed bailing air back to the interior of the drill string; and transmitting power to one or more components positioned in the drill string.

18. The method of claim 17, wherein the generating power comprises generating power based on a temperature differential between hot and cold air streams flowing through the thermal electric generator.

19. The method of claim 17, further comprising:

separating, with a vortex tube, the diverted portion of the bailing air into hot and cold air streams; and flowing the hot and cold air streams through the thermal electric generator, wherein the generating power comprises generating power based on a temperature differential between the hot and cold air streams flowing through the thermal electric generator.

20. The method of claim 17, wherein at least one component of the one or more components comprises a sensor, wherein at least one other component of the one or more components comprises a transmitter configured to receive information from the sensor, and to transmit the received information to a location outside of the drill string.

* * * * *